US006167935B1

(12) United States Patent
Heider et al.

(10) Patent No.: US 6,167,935 B1
(45) Date of Patent: Jan. 2, 2001

(54) LABELING MACHINE

(76) Inventors: James E. Heider, 811 W. Wooster St., Bowling Green, OH (US) 43402; Peter Heymann, Drakestrasse 12, 40545 Düsseldorf (DE)

( * ) Notice: Under 35 U.S.C. 154(b), the term of this patent shall be extended for 0 days.

(21) Appl. No.: 09/152,364

(22) Filed: Sep. 14, 1998

(51) Int. Cl.[7] ..... B65C 9/02; B65C 9/36; B65C 9/22

(52) U.S. Cl. ..... 156/567; 156/578

(58) Field of Search ..... 156/567, 568, 156/566, 578; 118/301, 504, 501; 269/21

(56) References Cited

U.S. PATENT DOCUMENTS

| | | | |
|---|---|---|---|
| 3,027,870 | | 4/1962 | Schirmer . |
| 3,048,146 | | 8/1962 | Coppola . |
| 3,088,859 | | 5/1963 | Smith . |
| 3,147,142 | * | 9/1964 | Rudo . |
| 3,295,491 | | 1/1967 | Cassarno . |
| 3,322,095 | | 5/1967 | Gelbjerg-Hansen et al. . |
| 3,422,793 | | 1/1969 | Lachmann . |
| 3,635,194 | | 1/1972 | Prior . |
| 3,748,210 | * | 7/1973 | Beutl . |
| 3,963,557 | | 6/1976 | Patterson . |
| 4,025,385 | * | 5/1977 | Wood ..... 156/272 |
| 4,188,843 | | 2/1980 | Dickey . |
| 4,210,481 | | 7/1980 | Wolff et al. . |
| 4,269,874 | | 5/1981 | Pryor et al. . |
| 4,332,635 | | 6/1982 | Holbrook et al. . |
| 4,338,155 | | 7/1982 | Buchele . |
| 4,354,887 | | 10/1982 | Total . |
| 4,369,214 | | 1/1983 | Pfulb et al. . |
| 4,544,431 | | 10/1985 | King . |
| 4,589,943 | | 5/1986 | Kimball et al. . |
| 4,595,449 | | 6/1986 | Nowicki . |
| 4,629,528 | | 12/1986 | Tanaka et al. . |
| 4,632,721 | | 12/1986 | Hoffman et al. . |
| 4,642,150 | | 2/1987 | Stemmler . |
| 4,671,843 | | 6/1987 | Olsen . |
| 4,687,535 | | 8/1987 | Voltmer . |
| 4,708,630 | | 11/1987 | Hammond . |
| 4,761,200 | | 8/1988 | Szeremeta . |
| 4,844,760 | | 7/1989 | Dickey . |

(List continued on next page.)

FOREIGN PATENT DOCUMENTS

| | | |
|---|---|---|
| 19544763 A1 | 6/1997 | (DE) . |
| 1446880 | 9/1965 | (FR) . |
| 94/15842 | 7/1994 | (WO) . |
| 98/17537 | 5/1998 | (WO) . |
| 98/19916 | 5/1998 | (WO) . |
| 98/36974 | 8/1998 | (WO) . |

OTHER PUBLICATIONS

Walter C. Larsen, A study in machine development, Modern Packaging (Mar. 1960), pp. 201–207.

*Primary Examiner*—Richard Crispino
*Assistant Examiner*—George R. Koch, III
(74) *Attorney, Agent, or Firm*—Emch, Schaffer, Schaub & Porcello, Co., L.P.A.

(57) ABSTRACT

Labeling machine for applying labels to containers with an adhesive station for applying adhesive to a back side of a label having an outer rim, whereby the adhesive is sprayed on the label to said outer rim with excess adhesive being sprayed beyond said outer rim, further with label transfer device, said transfer device having a holding plate for holding the label, which transfer device transfer labels from a label individualization position to a label applying position, whereby the adhesive is applied to the label while on the label transfer device, between the label individualization position and the label applying position, and with an adhesive receiving element having portions thereof located outwardly of the holding plate for receiving excess adhesive being sprayed.

11 Claims, 4 Drawing Sheets

U.S. PATENT DOCUMENTS

Figure 1:
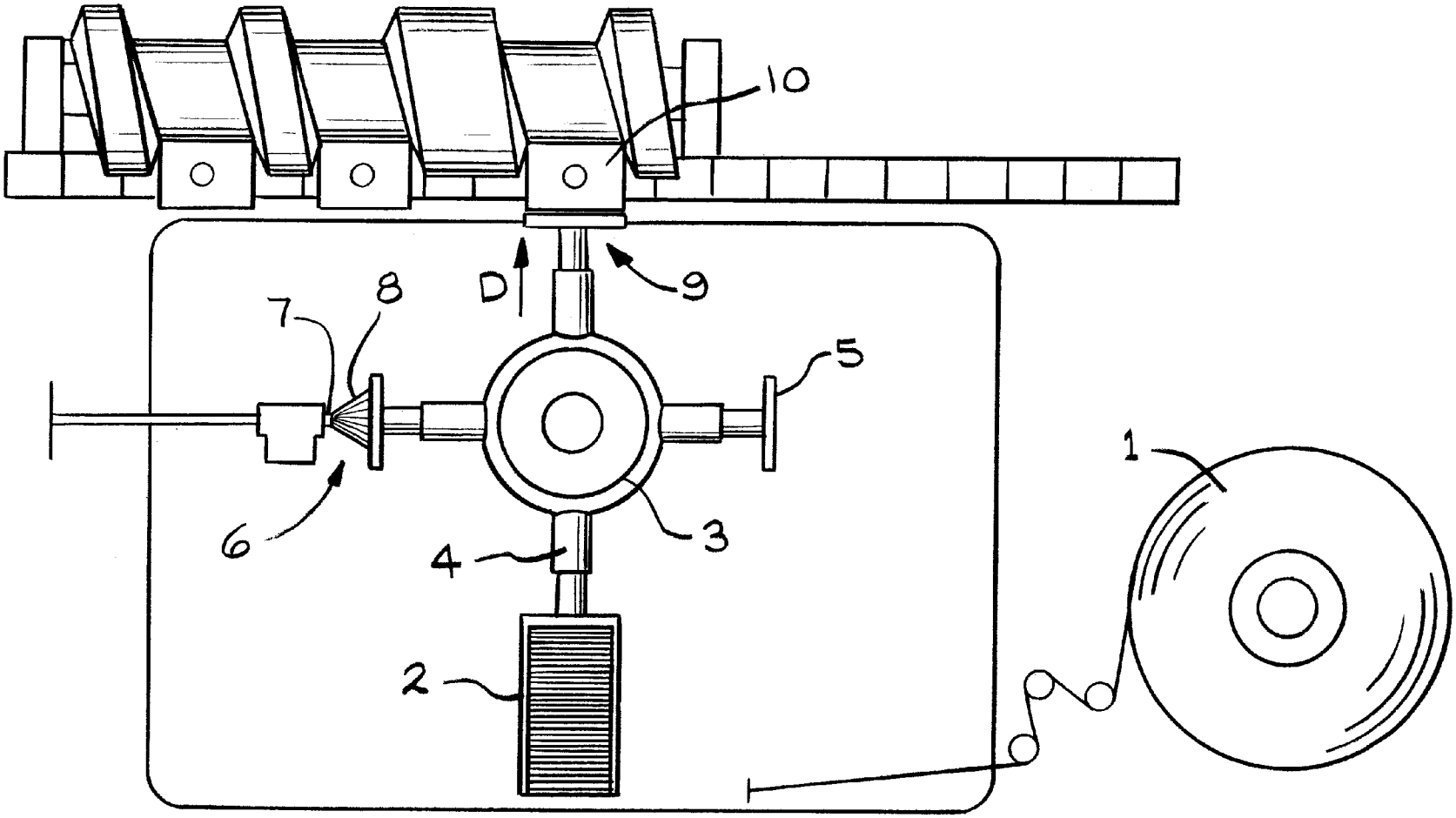

| | | | |
|---|---|---|---|
| 4,904,324 | 2/1990 | Heider . | |
| 4,978,415 | 12/1990 | Jones . | |
| 5,024,717 | 6/1991 | Winter . | |
| 5,032,344 | 7/1991 | Kaminski . | |
| 5,079,057 | 1/1992 | Heider . | |
| 5,116,452 | 5/1992 | Eder . | |
| 5,160,570 | 11/1992 | Dickey . | |
| 5,254,302 | 10/1993 | Yamanaka . | |
| 5,259,910 | 11/1993 | Biagiotti . | |
| 5,266,149 | 11/1993 | Collette et al. . | |
| 5,356,508 | 10/1994 | Watanabe . | |
| 5,405,667 | 4/1995 | Heider . | |
| 5,431,763 | 7/1995 | Bradshaw . | |
| 5,618,347 | 4/1997 | Clare et al. . | |
| 5,711,809 * | 1/1998 | Kimura et al. | 118/663 |

* cited by examiner

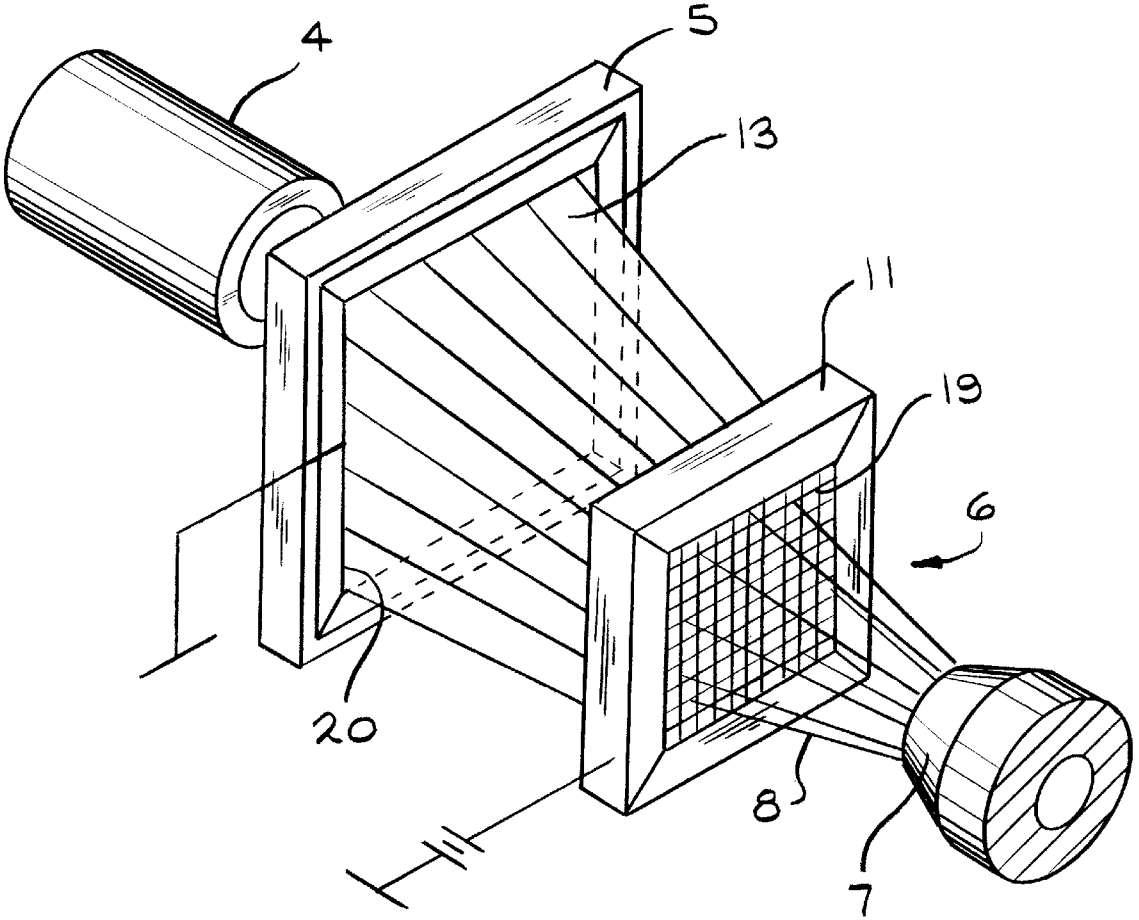
FIG. 4
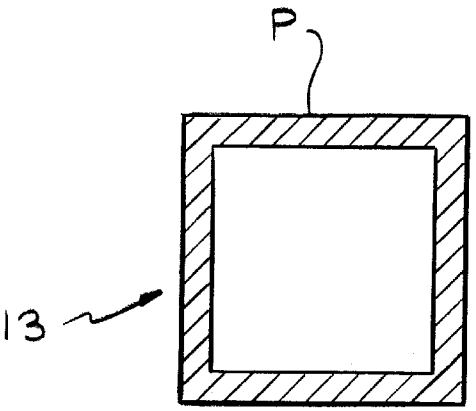
FIG. 5
FIG. 4

LABELING MACHINE

The invention is concerned with a labeling machine for applying labels to containers, with an adhesive station for applying adhesive to a back side of a label whereby the adhesive is prayed on the label, further with label transfer means, having a holding plate with an outer rim for holding the label, which transfer means transfer labels from a label individualisation position to a label applying position, whereby the adhesive is applied to the label while on the label transfer means, between the label individualisation position and the label applying position.

The invention is also concerned with a labeling machine with an adhesive station for applying adhesive to a container and applying thereafter the label on the container by means of the adhesive previously applied to the container.

It is known in the state of the art a labeling machine for example according to French patent 14 46 880 to spray adhesive onto a container and to press the label against the container in the area the adhesive has been applied to. Further it is known from this state of the art, to spray the adhesive through a frame in order to define exactly the area of the adhesive on the bottle. This area should match as much as possible, in its borderlines, with the label.

It has also already been proposed, to spray the adhesive, also through a frame, onto the back side of the label while on a holding plate and to apply the label thereafter to the container (see also the mentioned French patent).

In both cases, it is difficult, to confine the area, the adhesive is applied to. As far as the application to the bottle is concerned, there might be parts of the area which go beyond the rim of the label, applied lateron. In this case the results are unpleasant adhesive accumulations outside of the label. Also, it might be that the adhesive does not cover the whole area upto the rim of the label. In this case, the border of the label may become unsightly due to wrinkles. As far as the adhesive is applied to the back side of the label, there might be some amount of adhesive which goes outside of the rim of the label and does soil the further parts of the label holder or other parts of the labeling machine. In case the adhesive does not cover completely at least the border regions of the back side of the label, again the applied label may become unsightly due to wrinkles.

The invention is concerned with the object to have a labeling machine for linerless pressure sensitive labeling with an application of adhesive by spraying, whereby very precise matching with the borderlines of the label is reached.

According to a first idea of the invention, in order to reach the object outlined before, there is provided an adhesive receiving element surrounding the holding plate for the label. In case of applying the adhesive to the bottle, such adhesive receiving element can be laid over the bottle for the time, the adhesive is applied to the bottle. Or the bottle can be pressed against the element at the moment the adhesive is applied The adhesive receiving element is preferably made framelike. This element is further, in case it is related to a label holding plate, for example on a turret, preferably divided in at least two parts so that it can be removed from the holding plate. Further, the receiving element is located in or moveable in the plane of the receiving plate of the holding element or, in flow direction of the adhesive, behind the plane of the holding plate. The adhesive can be sprayed to the area, especially to the back side of a label, in a manner that it goes clearly beyond the outer rim of such label. The excess adhesive is then received on the adhesive receiving element. The adhesive receiving element has further means or is engagable with means to remove the excess adhesive from time to time from the receiving element. A first means to do so may be to heat the receiving element, which is the made from a metal material, at a temperature above the melting temperature of the adhesive. A further means can be to have the receiving element coated with a non-sticky surface, such a silicone. The adhesive may then fall down from time to time or it can be scraped from time to time from the surface.

The receiving element can be also described as a rear or catcher picture frame which has an outside dimension much larger than the label dimension and an inner hole that is smaller. The rear frame will catch and control the over-spray. By increasing the hole in the picture frame located between the spray source, the spray nozzle and the label (focus picture frame) the adhesive spray will cover the full back-side surface of the label all the way to and over the edges. The rear catcher frame located behind the label (between the label and the machine mechanism) will catch all the over-spray. The rear catcher frame can be designed to rotate or index with the turret resulting in a catcher for each station, or it could be designed to stay in a stationary position across from the focus picture frame and adhesive spray equipment. The focus picture frame is heated to allow the over-spray to melt and run down into a collection container. The catcher frame can also be heated or it can be designed to hold a paper or other through-away material that would accept the over-spray. The material could be replaced quickly when needed. The material could be adhered to the catcher frame with a POST IT-type adhesive to hold it in place. This would allow a very fast change.

For the cleaning of the adhesive receiving element also other methods are possible. For example the element can be vibrated from time to time, for example by exposure to ultrasonic. Dried adhesive may then be seperated thereby. It is also possible, maybe also from time to time, as already mentioned, to heat the element to a temperature above the melting temperature of the adhesive. The adhesive may flow thereby into a groove at the bottom of the element and from there into a recycle receptacle.

As to a coating of the receiving element, especially preferred is also a coating as described in german laid open publication 195 44 763. This publication is hereby incorporated by reference.

In case the receiving element is located behind the holding plate, it is further preferred, that the receiving element extends inwardly over the rim of the holding plate. Thereby, it is assured, that any excess adhesive, which goes over the rim of the holding plate, which does match with the rim of label, is received on the adhesive receiving element.

The adhesive receiving element can also be partly behind the holding plate and partly be flush with the holding plate. In this case, it is of advantage to have the receiving element made with a step, matching with the rim of the holding plate. Such element is then moveable from a position, in which the step is flush with the rim of the holding plate to a position, in which the step is distant to the rim of plate.

In order to avoid any threads or threadlets of the adhesive between the label and the label receiving element, it is also of advantage, to heat the respective rim of the holding plate. Additionally or alternatively can be also of advantage to heat the respective rim of the label. This can be done for example by an metallic coating of the respective rim of the label and an electrical induction heating of the rim of the label. As to this, in the label holding plate, electrically insulated from the label, is built an electrical circuit with a coil inducing an electrical current in the label and thereby heating the label or at least the rim thereof. The heating of the label can also be done simply by contact heating of the label on the holding plate, which then only needs to be heated.

It is also proposed by the invention, alternatively or in combination, to apply the adhesive within an electrical field. This can be done in different ways, for example by spraying the adhesive through a metallic net having a negative electrical charge. By such high charge, the molecules, especially the air molecules, get ionizated. Such ionizated molecules go then to the container or to the label, having a different electrical charge or no electrical charge. In this connection it can be of advantage, to have at least the rim of the label or the rim of the respective area on the container metallized and electrically connected to the respective electrical potential. The mentioned net is not absolutely necessary. In some cases it might be sufficient to charge electrically only the frame, having no net inside but just an opening and being positioned in distance to the label.

In all embodiments described, it is possible to heat the frame located in front of and with distance to the label, to which frame has been referred above to also a focus picture frame.

A further idea of the invention is a label material, to be cut into individual labels. The label material has for each individual label electrically conductive material following a rim portion of the desired label. Further, the conductive part can cover to whole area of the label and also the whole area of the label material. Such electrically conductive parts can for example be made by printing either to the back side or to the front side or per incorporating in between into the label respective electrically conductive parts.

A further idea of the invention are also containers applied with label having electrically conductive parts, at least at the rims of the labels.

Further, the invention is described with respect to the enclosed drawings, which are however only examples.

Figure 2:
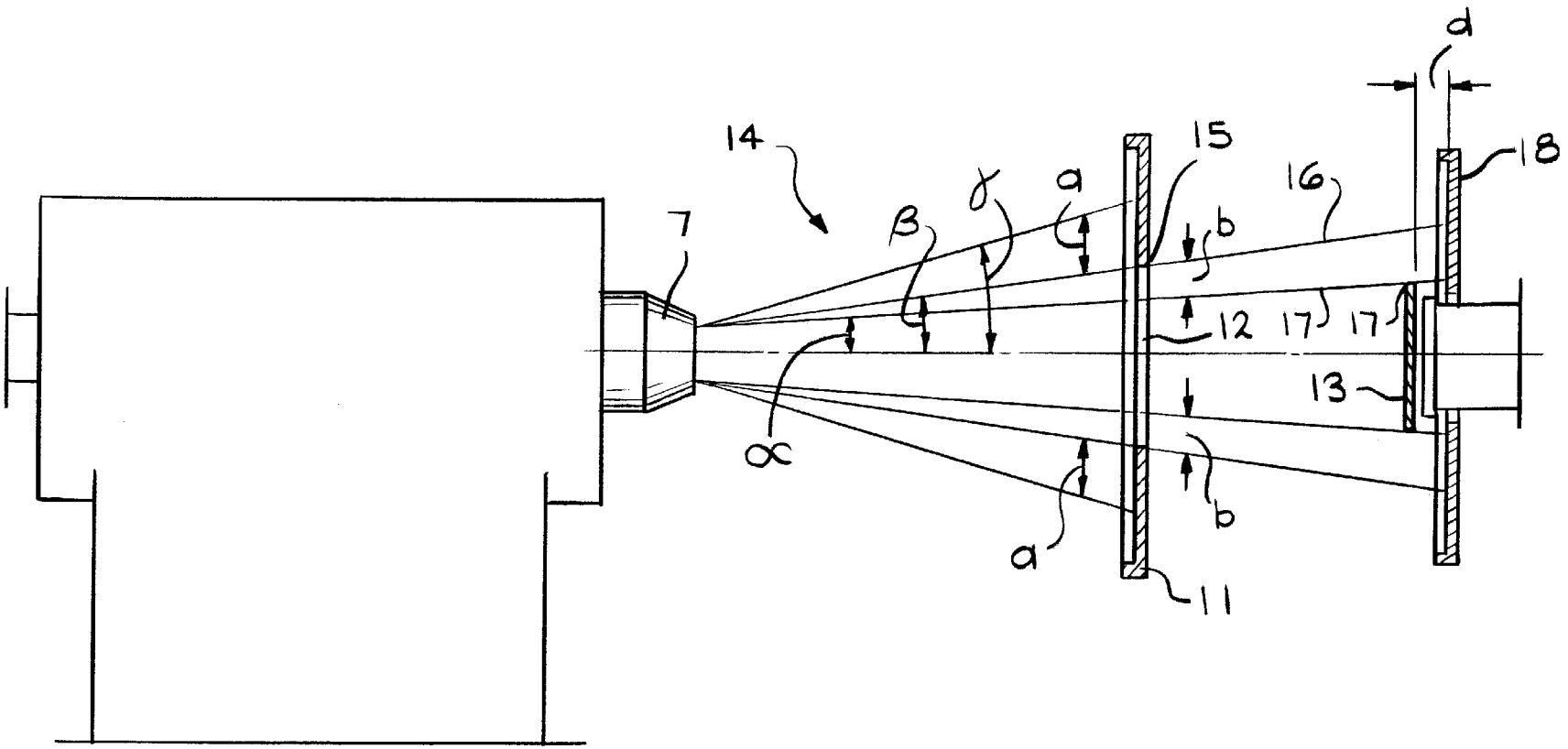
Figure 3:
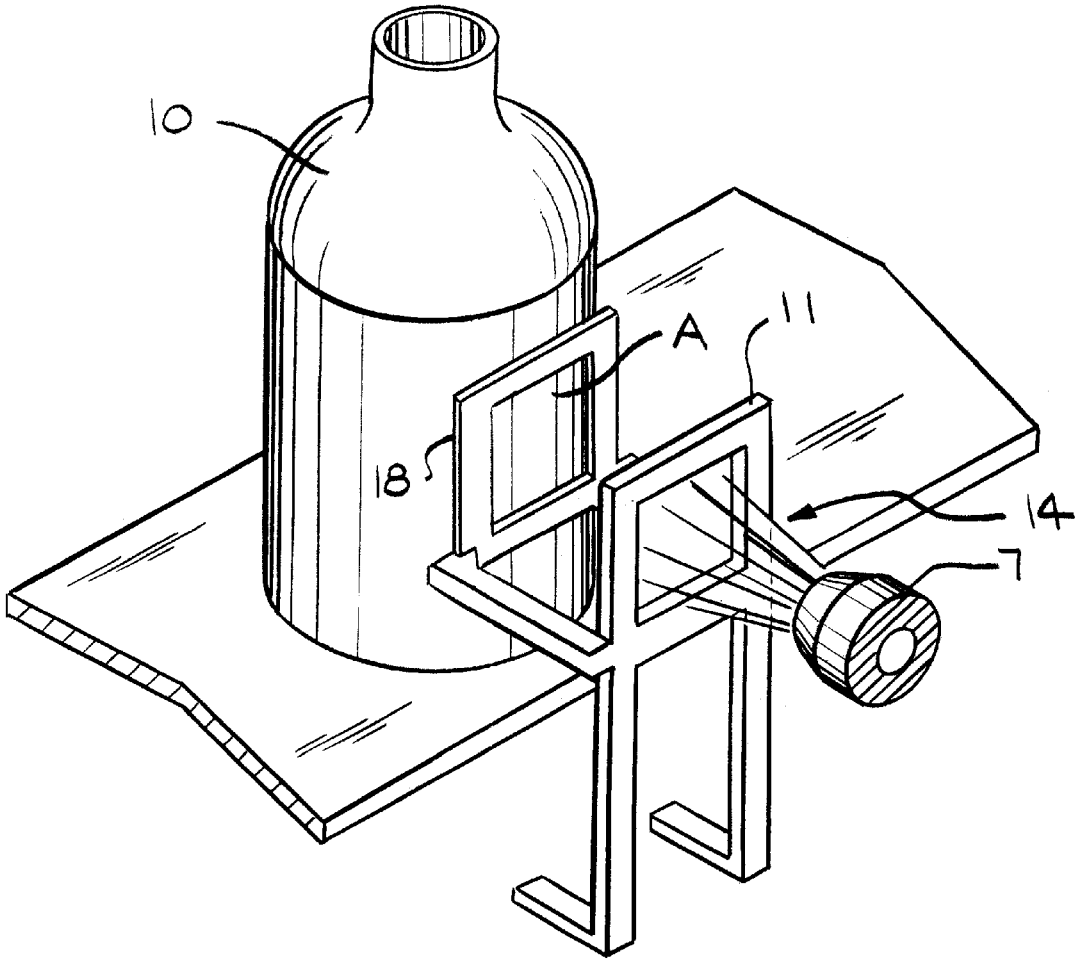

The figures of the drawings show:

FIG. 1 a schematic view from above onto the labeling machine;

FIG. 2 a schematic view from the side of a detail of the holding plate with the adhesive receiving element;

FIG. 3 a perspective view showing a container being applied with adhesive;

FIG. 4 a perspective view of an adhesive spraying onto the back side of a label, explaining the electrostatical charging of the adhesive and FIG. 5 a respective label from its back side.

With reference to FIG. 1 there is first shown a label supply 1 in form of a roll. The label band goes to a separation station not shown in detail here. For the separation station, reference is made for example to U.S. Pat. No. 4,336,095, with the difference, that the labels are not catched after separation by a vacuum drum but are collected in a supply holder 2 a described here.

The holder 2 works together with a turret 3, which has individual label holding plates 4, which move intermittently in a clockwise direction. The turret 3 has four arms 4 each of them having at their outer ends a label holding plate 5. The label holding plate 5 is also moveable in an axial direction D. It is moved against a label in the holder 2 and then backward to seperate one of the labels out of the label supply. This is reached by a vacuum, applied to several holes in the holding plate. Then the holding plate is moved backward, in the opposite direction of direction D and further moved in clockwise direction to the adhesive applying position 6. In the adhesive applying position, the label is in front of a spray nozzle 7, by which adhesive 8 is sprayed onto the back side of the label being held on the holding plate 5. The adhesive applying station especially is only shown schematically, without the frames described below in more detail. Then the label with such adhesive on its back side is further moved to the label applying position 9. By a further movement of the holding plate 5 in the direction D, the label is applied to a container 10. Further, the vacuum is interrupted while the holding plate 5 is again moved in the opposite direction of the direction D. The label is fixed to the container and the turret can be further moved in clockwise direction.

As shown schematically in FIG. 2 in the adhesive applying position, the adhesive is first sprayed through a frame 11. The frame 11 has an inner orifice 12, having nearly the same shape as the label 13.

The adhesive in the arrangement shown is sprayed with an spray angle Gamma extending between a center line L of the overal spray jet 14 and a borderline 15 of such spray jet.

The frame 11 extends radially, in case the spray jet has a circular cross section, over the outer line of the spray jet. This radial extension can be different, as a spray jet with a round cross section can be transformed by the frame 11 into one with for example rectangular cross section. Therefore, a first outer part of the spray jet in the area a, as shown in FIG. 2 in cross section, is sprayed against the surface of the frame 11 facing the spray nozzle 7 of the adhesive. A further part b between an angle Beta between the center line L and a line 16 emitting from the spray nozzle 7 and going just along the rim 15, defining the orifice 12, of the frame 11 and an angle Alpha between the center line L of the spray jet and a line 17, originating from the nozzle 7 and hitting just the outer rim 17 of the label 13, goes outside of the label 13. The adhesive of the spray jet in this area b goes around the label 13 and is catched by the adhesive receiving element 18. The adhesive receiving element 18 is located in a distance d behind the label 13 and the label holding plate. Further, the label receiving element is also frame-like designed. Further, what is not shown, this element 18 is divided into two parts, so that one can move for example one part upwardly the other part downwardly. This is of advantage for having a stationary adhesive receiving element 18.

FIG. 3 shows an embodiment in which the adhesive nozzle 7 is directed, through the frame 11, directly to the container 10. Reference is made to a machine and method as basically described in French patent 1446880. As shown the container 10 is held from behind against the adhesive receiving element 18, which is stationary with the first frame 11. The container is actually pressed from behind against the adhesive receiving element 18 and similarly as explained before, it is reached, that the adhesive is exactly on the area the label 13, applied lateron, needs. The area A, in which the adhesive is applied to the container does exactly match with the dimensions of the label 13.

The further embodiment according to FIG. 4 shows a part of the arrangement according to FIG. 1 It is a perspective view onto a holding plate 5 with a label 13 thereon. A back side of the label is facing to the nozzle 7. The spray nozzle sprays adhesive though a first frame 11. This frame 11 has additionally a metallic net 19 which covers the orifice 12 of the frame. This is however only optional. The principle described with resect to this embodiment would also function with a frame 11 described before, for example in connection with FIG. 2.

Of importance is, that the frame 11 and especially the net in the frame has a negative electrical potential of for example 10 kV. On the other hand, the label holder 5 and the label 13 itself, at least at its rim portion is on the electrical potential zero. Thereby, the adhesive, the single different jets of the adhesive, are—concerning the rim of the label 13—directed at the outer borderline of the label 13 exactly on the rim 20 of the label 13 by the lines of the electrical field created between the frame 11 and the label 13.

It is also possible to dispense with the frame 11 and to create the electrical potential difference only between the nozzle 7 an the label 13 (the rim 20 thereof).

In FIG. 5, a respective label is shown principally. Of importance is, that the rim portion P of the label 13 (shown is the back side of the label) is electrically conducting. Further, there is an electrically conducting connection between the label holder and the label itself, assuring, that the label, at least its rim portion P, is on the said electrical potential zero while held on the holder.

The electrically conducting rim portion P on the label is made for example by a printed application of electrically conducting particles. Only the rim portion P of the label 13 needs to be printed with such electrically conducting particles. However, it is also possible to print the whole back side of the label with such conducting particles.

Also in connection with the embodiments described with respect to FIGS. 1 and 2, such label could be of advantage. In this respect, it is possible to heat such label or at least its rim portion, while on the label holder, by electrically inductive heating. This is of advantage in respect of any tendency of the adhesive to build threads between the rim portion of the label and the adhesive receiving element, for example because the adhesive has not enough temperature when reaching the label.

What is claimed is:

1. Labeling machine for applying labels to containers with an adhesive station for applying adhesive to a back side of a label having an outer rim, whereby the adhesive is sprayed on the label to said outer rim with excess adhesive being sprayed beyond said outer rim, further with label transfer means, said transfer means having a holding plate for holding the label, which transfer means transfer labels from a label individualisation position to a label applying position, whereby the adhesive is applied to the label while on the label transfer means, between the label individualisation position and the label applying position, and with an adhesive receiving element having portions thereof located outwardly of the holding plate for receiving excess adhesive being sprayed.

2. Labeling machine according to claim 1, whereby the receiving element is located behind the holding plate, in a spray direction of the adhesive.

3. Labeling machine according to claim 1 wherein said label has an outer rim and said receiving element extends inwardly beyond said label rim.

4. Labeling machine according to claim 1 whereby said receiving element is heated.

5. Labeling machine according to claim 1 whereby said receiving element moves with said holding plate.

6. Labeling machine according to claim 1 whereby said receiving element is divided into two parts and is stationary.

7. Labeling machine according to claim 1 whereby the receiving element has a step matching with the rim of said holding plate and the receiving element is moveable from a position in which said step is flush with the rim to a position in which said step is distant to the rim of said holding plate.

8. Labeling machine according to claim 1 whereby the holding plate has means for heating the label by induction.

9. Labeling machine according to claim 1 whereby said adhesive receiving element is a frame-like structure and said holding plate extends through said adhesive receiving element.

10. Labeling machine according to claim 9 whereby said holding plate maintains said label in spaced relationship with said adhesive receiving element when adhesive is applied to said label.

11. Labeling machine according to claim 1 whereby said receiving element has a coating on the surface which receives said excess adhesive.

* * * * *